US006100856A

United States Patent [19]

Råbe

[11] Patent Number: 6,100,856

[45] Date of Patent: Aug. 8, 2000

[54] DEVICE FOR ANTENNA SYSTEMS

[75] Inventor: Berndt Erik Roland Råbe, Häradsdomarevägen, Sweden

[73] Assignee: Telefonaktiebolaget LM Ericsson, Stockholm, Sweden

[21] Appl. No.: 09/089,517

[22] Filed: Jun. 3, 1998

[30] Foreign Application Priority Data

Jun. 6, 1997 [SE] Sweden ..... 9702181

[51] Int. Cl.[7] ..... H01Q 3/02

[52] U.S. Cl. ..... 343/882; 343/766; 343/912

[58] Field of Search ..... 343/766, 882, 343/815, 817, 818, 892, 912; H01Q 3/02

[56] References Cited

U.S. PATENT DOCUMENTS

| | | | |
|---|---|---|---|
| 2,531,455 | 11/1950 | Barrow et al. | 250/33.65 |
| 2,803,007 | 8/1957 | Edelman | 343/762 |
| 4,295,621 | 10/1981 | Siryj | 248/183 |
| 4,656,486 | 4/1987 | Turner | 343/882 |
| 4,755,825 | 7/1988 | Crochet et al. | 343/757 |
| 4,772,892 | 9/1988 | Payelian et al. | 343/765 |
| 5,153,485 | 10/1992 | Yamada et al. | 318/35 |
| 5,633,647 | 5/1997 | Tines | 343/766 |

FOREIGN PATENT DOCUMENTS 155922 1/1921 United Kingdom .

*Primary Examiner*—Don Wong
*Assistant Examiner*—Shih-Chao Chen
*Attorney, Agent, or Firm*—Burns, Doane, Swecker & Mathis, L.L.P.

[57] ABSTRACT

A device for angular adjustment of a direction-indicating object of an antenna device such that the direction-indicating object performs a mechanical movement without rotating. The inside of a first end of a rigid tube is rotatably arranged via two bearing devices in relation to a fixed part of the antenna device around an axis of rotation, the fixed part is attached to a foundation. An antenna part of the antenna device includes the direction-indicating object. The antenna part is rotatably arranged via a bearing device on a bevelled outer edge of a second end of the tube around a central axis. The outer edge is bevelled to an intended fixed angle which determines the fixed angular adjustment of the antenna part with respect to the fixed part of the antenna device. A cardan coupling is arranged between the fixed part and the antenna part such that the cardan coupling prevents the antenna part from being able to rotate in relation to the fixed part. The antenna part will perform a nutation movement along the outer edge of the tube when the tube is brought into rotation around the fixed part of the antenna device.

19 Claims, 3 Drawing Sheets

DEVICE FOR ANTENNA SYSTEMS

This application claims priority under 35 U.S.C. §§119 and/or 365 to SE 9702181-0 filed in Sweden on Jun. 6, 1997; the entire content of which is hereby incorporated by reference.

FIELD OF THE INVENTION

The present invention relates to a device for adjusting the angle of a direction-indicating object in an arbitrary direction.

STATE OF THE ART

According to the prior art, the steering of antenna lobes in antenna devices, for e.g. radar use takes place mechanically to a great extent and in certain cases also in combination with electronic steering. The electronic steering leads to that more electronics in the form of transmitter, receiver, and phase-shift modules are placed in direct connection with the antenna device itself, whereby the mass of the antenna device increases which sets great demands on the mechanical devices which are to perform the mechanical steering of the antenna device.

Furthermore, all the spatial coordinates within a selectable region can be set through a combination of an electronic and a mechanical steering of the antenna device.

For certain antenna systems there is the requirement that the antenna device must not have a rotating movement in relation to its part attached to its support, but that a certain given axis in the coordinate system of the antenna device all the time must be parallel with a certain plane in the fixed coordinate system of the antenna device. A nutation movement of a device means that the device turns around a stationary point without performing a rotating movement, i.e. that a certain axis in the coordinate system of the device is all the time parallel with a certain plane in the fixed coordinate system of the device.

There are often high requirements for directional accuracy in an antenna device, which in turn demands a high stiffness in the antenna device.

U.S. Pat. No. 4,772,892 describes a balance device for use in a radar system, whereby a parabolic reflector is mechanically controlled with respect to an axis of inclination and a yaw axis. The balance device includes a hollow spherical bearing which supports the parabolic reflector.

The parabolic reflector is made to move to an arbitrary position through rotation of two separate orthogonal curved plates, which are brought into contact with orthogonal plate followers via springs. The orthogonal plate followers are in turn attached to the parabolic reflector.

A disadvantage with this device is that it is not intended to be combined with electronic control of the direction of the antenna lobes, and thereby the device becomes extremely complicated.

GB Patent 155 922 describes a device for mechanical adjustment of the plane of a platform in an apparatus to a selectable inclination and rotation via a number of casings.

A disadvantage with this device is that the construction is complicated and that it is not intended to be combined with an electronic fine adjustment of the plane.

DISCLOSURE OF THE INVENTION

One problem which the invention solves is how to, with a simple construction of an antenna device, achieve that a direction-indicating object on the antenna device performs a mechanical movement without rotating.

Another problem is how to, in a simple way, achieve a high directional accuracy of the direction-indicating object in arbitrary direction within an intended region.

One object of the present invention is consequently to, by a simple construction of the antenna device, provide that the direction-indicating object of the antenna device performs a mechanical movement without rotating and to achieve a high directional accuracy of the direction-indicating device in arbitrary directions within an intended region.

To achieve this, the present invention uses a torsionally stiff connection between a directional part, also called an antenna part below, comprising the direction-indicating object, and a fixed part on the antenna device, and a bevelling of a movable part of the antenna device. The invention further uses a stiff movable part.

In more detail, the problems are solved through the fixed part of the antenna device being fixed in a foundation and the movable part of the antenna device comprising a tubular means, called tube below, rotatably arranged against the fixed part of the antenna device around an axis of rotation. The tube comprises a first end arranged on the fixed part via at least one inner bearing means, and a second end of the tube comprises an outer edge bevelled to an intended fixed angle. The inner bearing device has a large inner diameter whereby it is stable against forces from exterior loads.

The antenna part of the antenna device is rotatably arranged around a central axis via at least one outer bearing device on the bevelled outer edge of the tube. The torsionally stiff coupling is arranged between the fixed part and the antenna part, whereby the torsionally stiff coupling prevents the antenna part from being able to rotate in relation to the fixed part. The antenna part performs a nutation movement, described above, when the tube is made to rotate.

One end of the torsionally stiff coupling is arranged on the fixed part on the axis of rotation of the tube. The other end of the torsionally stiff coupling is arranged on the antenna part on the central axis of the antenna part, which runs through the centre of rotation of the antenna part in relation to the movable part.

At least one motor can, via a transmission coupling, bring the tube of the antenna device into rotation in relation to the fixed part of the antenna device to an intended rotation angle.

The fixed angle of the outer edge of the tube determines the fixed angular adjustment of the antenna part with respect to the fixed part of the antenna part.

The construction of the antenna device according to the invention permits the placement of the centre of gravity of the antenna part so that the centre of gravity coincides with the central axis and the rotational axis of the tube, whereby the load of the antenna part on the fixed part of the antenna device and its drive system is minimized.

A signal direction for transmitted signals, which in the text below includes both transmitted and received signals, from the direction-indicating device can be extended through an electronic angular adjustment, which displaces the signal direction a further intended propagation angle in addition to the above mentioned fixed angle and rotational angle, whereby the transmitted signals can be directed to an arbitrary direction within an intended region.

One advantage of the present invention is that the antenna part of the antenna device does not have a rotating movement in relation to the fixed part as the torsionally stiff coupling functions as a counterstay between the fixed part of the antenna device and the antenna part, whereby no rotatable cable devices such as e.g. rotatable connectors or slip-ring connectors need to be used in the antenna part because it does not rotate in relation to the fixed part.

Another advantage is the possibility of being able to place the point of rotation of the antenna part in a selected position along the axis of rotation of the tube through selecting a suitable fixed angle for the bevelled outer edge of the tube and a suitable displacement of the centre of rotation of the antenna part from the axis of rotation of the tube.

Yet another advantage is that the invention provides a high directional accuracy of the direction-indicating object as the antenna device achieves a high stiffness through the torsionally stiff coupling between the fixed part of the antenna device and the antenna part and through the movable part of the antenna part being made of a tube which in itself is stiff. Furthermore, a high directional accuracy is obtained through the inner bearing device having a large inner diameter whereby it is stable against forces from exterior loads.

Still another advantage is that signals transmitted from the direction-indicating object can take place in arbitrary directions within an intended region through, on the one hand, a combination of the fixed angle and adjustment of the angle of rotation and, on the other hand, through the electronic angular setting.

The invention will now be described more closely by means of preferred embodiments and with reference to the accompanying drawings.

PREFERRED EMBODIMENTS

The present invention uses a mechanical and an electronic angular adjustment of a direction-indicating object in an antenna device to an arbitrary direction inside an intended region in e.g. space, wherein a larger coverage region is obtained for the adjustment of the direction-indicating object compared to a pure mechanical adjustment or a pure electronic adjustment of the direction-indicating object.

The mechanical angular adjustment of the direction-indicating object according to the invention occurs in the form of a nutation movement around a point of rotation of the antenna device. A nutation movement is a tilting movement around a stationary point and in the following example a direction part, also called antenna part below, of the antenna device performs a nutation movement around its centre of gravity $T_p$. The nutation movement as opposed to a rotational movement means that the coordination system for the antenna part does not rotate around any of the X-Y-Z axes of the coordination system of the antenna device but only turns around a point with a fixed and predetermined angular adjustment.

The mechanical angular adjustment of the direction-indicating object according to the invention can be considered as a form of coarse adjustment of the direction in e.g. space of the direction-indicating object, whereby the electronic steering of the direction-indicating object can be considered to be a fine adjustment of the direction for transmitted signals which in the text below include both transmitted and received signals, from the direction-indicating object, and an extension of the total region of coverage.

The electronically fine-adjusted angular adjustment means that all spatial coordinates within the mechanically adjustable region of direction can be covered by the direction-indicating object.

An example of an embodiment of an antenna device 1 according to the invention will be described below in connection with FIGS. 1 and 2.

Figure 1:
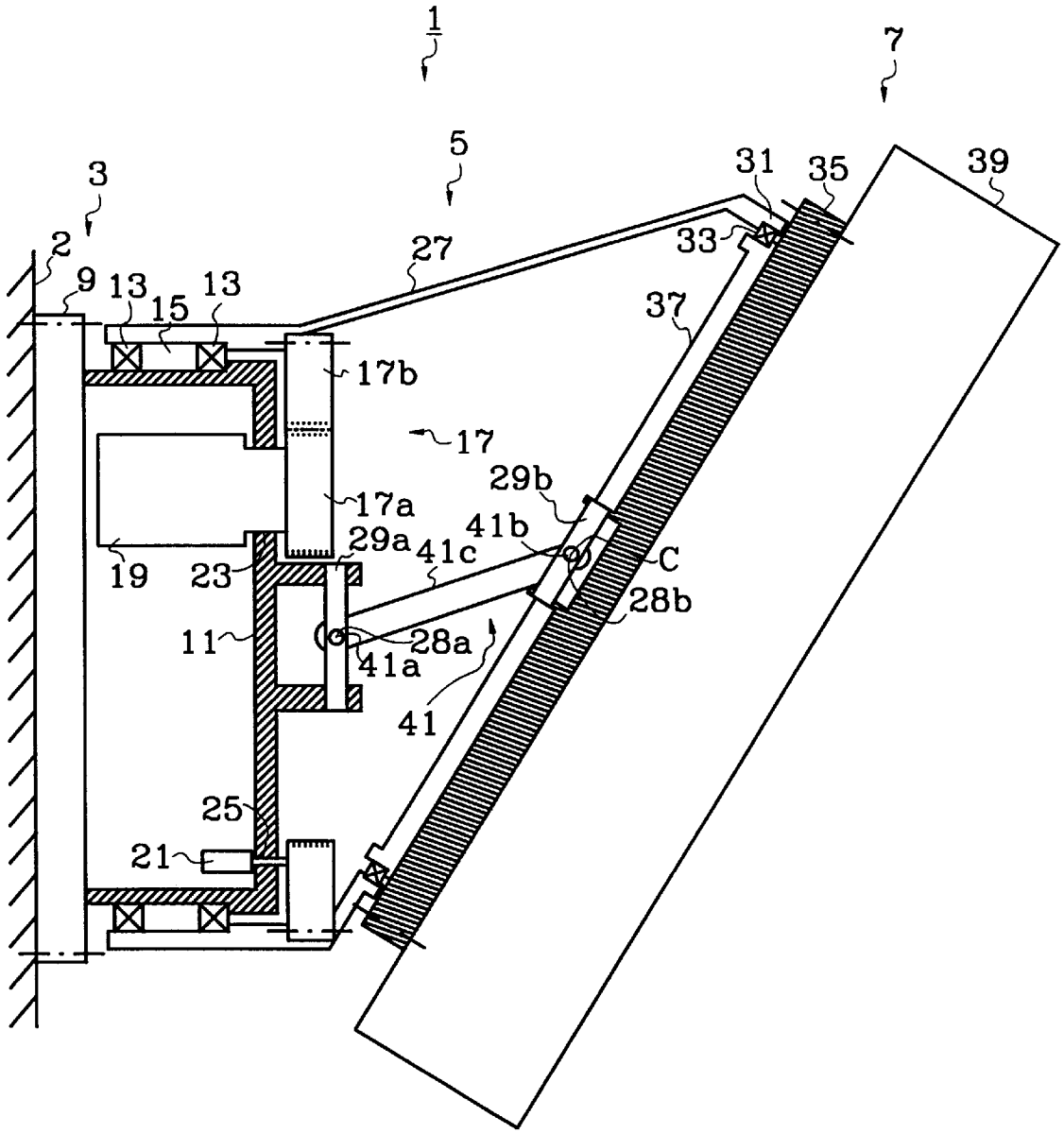
FIG. 1 shows a schematic side view of an antenna device according to the invention.
Figure 2:
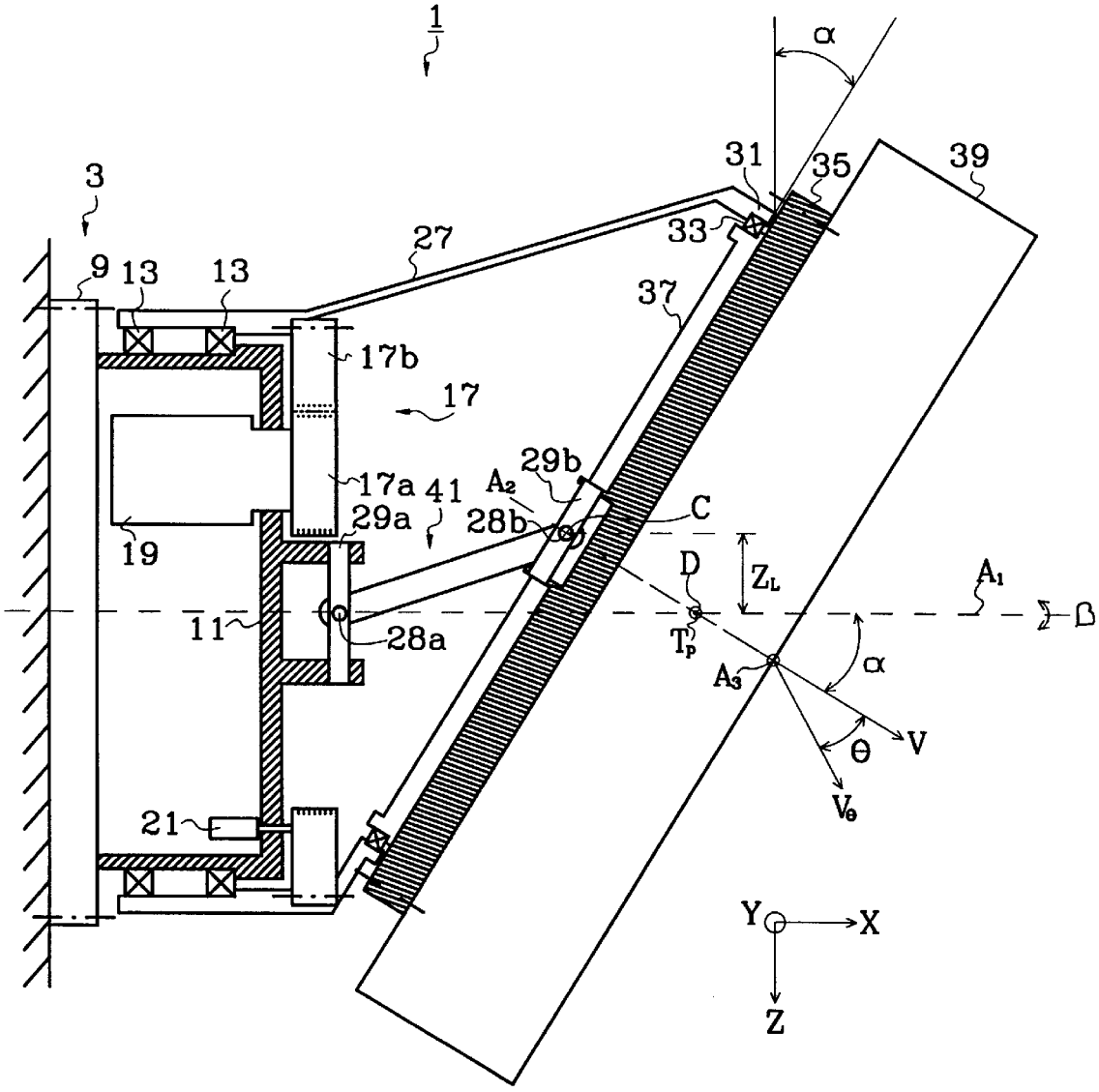
FIG. 2 shows a schematic side view of the antenna device, which side view includes the geometric relationships of the antenna device according to the invention.

FIG. 1 shows a side view of the antenna device 1 and FIG. 2 shows the geometric relationships of the antenna device 1 according to FIG. 1.

The antenna device 1 can, for example, be a radar antenna.

The antenna device 1 comprises a fixed part 3, a movable part 5, and the antenna part 7.

The fixed part 3 of the antenna device 1 comprises an inner fastening plate 9, an inner casing arrangement 11, two inner bearing arrangements 13, a distance piece 15, a gear drive 17*a*, a motor 19 and a feedback device 21.

The inner fastening plate 9 is attached to a foundation 2, and the inner casing device 11 is attached to the inner fastening plate 9, as is evident from FIG. 1.

The inside of the two inner bearing arrangements 13 are arranged on the inner casing arrangement 11 and the two inner bearing arrangements 13 have a large inner diameter and are separated by the distance piece 15 which is arranged between them, whereby the torsional rigidity of the inner bearing arrangements 13 is improved.

The motor 19 is placed inside the inner casing arrangement 11, see also FIG. 1, whereby a first part of the motor 19 is attached to the inner casing arrangement 11 and the first part projects out of the inner casing arrangement 11 through a first notch 23 in the inner casing arrangement 11.

The gear drive 17*a* is attached to the first part of the motor 19.

The feedback device 21, placed inside the inner casing device 11, extends out through a second notch 25 in the inner casing arrangement 11. The feedback device 21 is not limited to being placed here but also other alternatives are possible.

The movable part 5 of the antenna device 1 comprises a slanking cut-off tubular means 27 and an internal gear ring 17*b*. The tubular means 27 is also called a tube below.

The tube 27 in turn comprises a first end and a second end.

The inside of the first end of the tube 27 is arranged outside the two inner bearing devices 17 and the internal gear ring 17*b* is placed beside the two inner bearing devices 17 and arranged internally towards the inside of the first end of the tube 27 as is shown in FIG. 1.

The gear drive 17*a* and the internal gear ring 17*b* cooperate with each other and form a geared connection 17, whereby the motor 19 via the gear drive 17*a* which influences the internal gear ring 17*b* can make the tube 27 rotate around the inner housing arrangement 11 via the two inner bearing devices 13.

The invention is not limited to a gear connection 17 but also other forms of transmission connections for the driving of the tube 27 around the inner casing arrangement 11 can be used, e.g. belt-driven connections or chain-driven connections.

The part of the feedback device 21, which projects out of the second notch 25 in the inner casing arrangement 11, is in contact with the internal gear ring 17*b* via e.g. an optical reader (not shown in the Figure). The feedback device 21 is not limited to this contact but also other alternatives are possible. For example, the feedback device 21 can be in contact with the inside of the tube 27.

The feedback device 21 has the function of reading the angle of rotation β that the tube 27 rotates around its axis of rotation $A_1$, see also FIG. 2. The optical reader reads, for example, a pattern of markings attached to the internal gear ring 17*b* on the inside of the tube 27, whereby the angle of rotation β can be obtained and fed back to a regulation system (not shown in the Figure) in which the motor 19 is included. This regulation system can be placed outside the antenna device 1.

An outer edge 31 of the second end of the tube is bevelled to a fixed angle α.

The antenna part 7 of the antenna device 1 comprises an outer bearing arrangement 33, an outer fastening plate 35, an outer casing device 37, and a direction-indicating object 39.

The tube 27 can be a mechanical structure which unites the inner bearing arrangements 13 with the outer bearing arrangements 33 at a well-defined distance from each other.

The outside of the outer bearing arrangement 33 is arranged on the bevelled outer edge 31 of the second end of the tube 27, and the outside of the outer casing arrangement 37 is arranged on the outer bearing arrangement 33, as is evident from FIG. 1.

Furthermore, the outer fastening plate 35 is attached to the outer casing arrangement 37 and the direction-indicating object 39 is in turn attached to the outer fastening plate 35.

The outer casing arrangement 37 forms together with the outer fastening plate 35 a rotatable surface for the direction-indicating object 39 so that the antenna part 7 is rotatably arranged on the outer edge 31 of the tube 27 around a central axis $A_2$. The central axis $A_2$ goes through the centre of rotation C of the outer bearing arrangement 33, whereby the central axis $A_2$ runs parallel with a normal to the bevelled outer edge 31 of the tube 27.

The coordinate system X-Y-Z of the antenna arrangement in the present invention is fixed in relation to the fixed part 3, whereby the X-axis is parallel with the axis of rotation $A_1$, and the Y-axis and Z-axis are both perpendicular to each other and to the X-axis. The X-axis and the Z-axis lie in the plane of the paper according to FIG. 2.

A cardan shaft 41*c* is rotatably arranged at a first end around a first crosslink 28*a* and at a second end rotatably arranged around a second crosslink 28*b*. The first crosslink 28*a* is part of a first cardan joint 41*a* and the second crosslink 28*b* is part of a second cardan joint 41*b*.

The first crosslink 28*a* intersects the axis of rotation $A_1$ and is arranged in the X-Y plane, and is arranged perpendicular to a first link 29*a*, which first link 29*a* is parallel with the Z-axis according to FIG. 2.

The first link 29*a* is arranged on the inner casing device 11 in the fixed part 3 of the antenna device 1.

The second crosslink 28*b* intersects the central axis $A_2$ and is arranged in the X-Y plane, and is arranged perpendicular to a second link 29*b*, arranged perpendicular to the central axis $A_2$. In FIG. 1 the second crosslink 28 passes through the centre of rotation C of the outer bearing arrangement 33 which forms an example of how the second crosslink 28*b* can be arranged.

The second link 29*b* is arranged on the outer fastening plate 35 in the antenna part 7 of the antenna device 1, see also FIG. 1.

The first cardan joint 41*a* and the second cardan joint 41*b* form together with the cardan shaft 41*c* a so-called torsionally stiff cardan coupling 41, which functions as a counter between the fixed part 3 and the antenna part 7 of the antenna device 1, whereby the antenna part 7 cannot rotate in relation to the fixed part 3, see also FIG. 2.

The cardan coupling 41 holds the direction-indicating object 39 stable and prevents the direction-indicating object 39 from being able to rotate around the axis of rotation $A_1$ and the central axis $A_2$ when the tube 27 is brought into rotation.

The invention is not limited only to being able to comprise the above described cardan coupling 41 but it is possible to use also other equivalent torsionally stiff couplings, e.g. flexible tubes which are rigid for torsional movements.

Furthermore the invention is not limited to comprising two inner bearing arrangements 13 or only one outer bearing arrangement 33 as described above, but also a greater or lesser number of bearing devices can be used. Two inner bearing devices 13 are used in the present example which improves the torsional rigidity of them.

The fixed angle α determines the fixed angular adjustment of the antenna part 7 of the antenna device 1 with respect to the fixed part 3 of the antenna device, see FIG. 2.

When the motor 19 starts, the gear drive 17*a* will begin to rotate, whereby the gear drive 17*a*, through cooperating with the internal gear ring 17*b* attached in the tube 27 as described above, will bring the tube 27 into rotation around the inner casing device 11 via the two inner bearing devices 13.

The outer edge 31 of the other end of the tube 27 will rotate around the outer casing device 37 via the outer bearing arrangement 33, whereby the direction-indicating object 39 attached to the outer fastening plate 35, which in turn is attached to the outer casing arrangement 37, does not rotate in relation to the fixed part 3 while at the same time as the direction-indicating object 39 will perform a nutation movement along the outer edge 31 of the tube. A pointer normal V of the direction-indicating object 39 consequently turns around a stationary point without rotating, see also FIG. 2.

The rotationally stiff cardan coupling 41 prevents the direction-indicating object 39 from rotating around the axis of rotation $A_1$ and the central axis $A_2$, as mentioned above, at the same time as high accuracy is obtained for the directing of the direction-indicating object 39 to a specific angular position.

FIG. 2 shows the geometric relationships of the antenna device 1 according to the invention. In FIG. 2 the central gravity $T_p$ of the antenna part 7 coincides with the axis of rotation $A_1$ and the central axis $A_2$ of the outer bearing device 33, whereby the antenna part 7 will perform a nutation movement around its centre of gravity $T_p$. The centre of gravity $T_p$ remains still and the pointer normal V out from the antenna part 7 turns around the stationary centre of gravity $T_p$. An axis D through the centre of gravity $T_p$, which axis D is parallel with the Y-axis in FIG. 2, will always be parallel with the X-Y plane in the fixed coordinate system of the antenna device when the antenna part 7 performs a nutation movement. An axis $A_3$ in FIG. 2 is an axis on the periphery of the direction-indicating object 39, and the axis $A_3$ is parallel with the axis of the centre of gravity D. This axis $A_3$ remains the whole time parallel with the X-Y plane in the fixed coordinate system of the antenna device when the antenna part 7 performs a nutation movement.

The perpendicular distance to the axis of rotation $A_1$ between the centre of gravity $T_p$ of the antenna part and the centre of rotation C of the outer bearing device 33 is called the central length and has the reference $Z_L$ in FIG. 2. The tube 27 rotates the angle of rotation β around its axis of rotation $A_1$, and the other end of the tube 27 is bevelled with a fixed angle α.

Through selecting a suitable fixed angle a on the bevelling of the outer edge 31 of the tube 27 and a suitable central distance $Z_L$ as described above, the centre of gravity $T_p$ of the antenna part 7 coincides with the axis of rotation $A_1$ and the central axis A2 of the outer bearing device, as is the case in the above example and as is shown in FIG. 2, whereby the direction-indicating object 39 turns around the centre of gravity $T_p$. This leads to that the total mass moment of inertia and outer balance moment of the antenna device are minimized. In the same way, the load from the antenna part 7 on the motor 19 and on the fixed part 3 of the antenna device 1 is also minimized.

The invention is not limited to the above mentioned position of the centre of gravity $T_p$. Through selecting other values of the fixed angle a and the central distance $Z_L$, another point of the antenna part 7 than the centre of gravity $T_p$ can be made to coincide with the axis of rotation $A_1$ of the tube and the central axis $A_2$ of the outer bearing arrangement, whereby the direction-indicating object 37 rotates around this point instead, the so-called turning point. For example, the antenna part turns around a first point on the axis $A_3$ if this first point coincides with the axis of rotation $A_1$ and the central axis $A_2$. Both the axis D through the centre of gravity $T_p$ and the axis $A_3$ are the whole time parallel with the X-Y plane in the fixed coordinate system of the antenna device when the tube is brought into rotation. The axis D through the centre of gravity $T_p$ will move along the periphery of a cone-shaped region with the top angle 2α, whereby the axis $A_3$ will travel through the tip of the cone-shaped region in this case.

As the antenna part 7 of the antenna device 1 can contain a lot of electronics for signal generation and control of the electronic adjustment of the direction-indicating object 39 to selected directions, large amounts of cables run between the fixed part 3 and the antenna part 7 of the antenna device 1. Through the nutation movement of the direction-indicating object, according to the invention no rotatable cable arrangements, such as e.g. rotatable connectors or slip-ring connectors, need to be used in the antenna part 7, as this does not rotate in relation to the fixed part 3.

The aiming of the direction-indicating object 39 according to the present example is performed through rotating the tube 27 the angle of rotation β. The direction of the pointer normal V of the direction-indicating object 39 is thereby determined by the angle of rotation β and furthermore by the mechanical bevelled fixed angle α of the tube 27. The pointer normal V can consequently reach arbitrary directions along the periphery of a cone-shaped region with the top angle 2α with a 360° region of coverage for the angle of rotation β.

In an alternative embodiment of the invention according to the previous example, control of a signal direction of the direction-indicating object 39 can be a complement for larger regions of coverage. This can be performed through electronically rotating the signal direction a further intended angle of rotation θ, see also FIG. 2, in addition to the above mentioned fixed angle α and angle of rotation β. In this way a new signal direction denoted $V_\theta$ in FIG. 2 is obtained. This technique is well-known to a person skilled in the technical field.

In this case, the signal direction $V_\theta$ in the above example in connection to FIG. 1 can be made to point straight forward in a direction parallel to the angle of rotation $A_1$ of the tube, when the rotation angle θ equals the fixed angle -α. The signal direction $V_\theta$ can point in any arbitrary direction within a cone-shaped region with the top angle 2α+2θ with a 360° region of coverage for the angle of rotation β. Thereby the direction-indicating object 39 can be set to any arbitrary direction within the cone-shaped region.

In yet an alternative embodiment of the invention, according to the above example in connection to FIGS. 1 and 2, one end of the torsionally stiff cardan coupling 41 is attached to the inner casing device 11 in the fixed part 3 of the antenna device 1 on the axis of rotation $A_1$ of the tube. The other end of the torsionally stiff cardan coupling 41 comprises the above described second cardan joint 41*b*, which in the present example is arranged at the point of the antenna part 7 which coincides with the axis of rotation $A_1$ and the central axis $A_2$. In the above example according to FIGS. 1 and 2, this point forms the centre of gravity $T_p$ of the antenna part.

A second crosslink 28*b* is comprised in the second cardan joint 41*b* in the same way as described above. The second crosslink 28*b* intersects the central axis $A_2$ and is arranged in the X-Y plane and is perpendicularly arranged against a second link 29*b*, arranged perpendicular to the central axis $A_2$.

Furthermore, the second crosslink 28b passes through the centre of gravity $T_p$ of the antenna part, when this point coincides with the axis of rotation $A_1$ and the central axis $A_2$, as is the case in the above example according to FIG. 1 and 2.

The second link 29*b* is arranged onto the outer attachment plate 35 in the antenna part 7 of the antenna device 1, see also FIG. 1.

Figure 3:
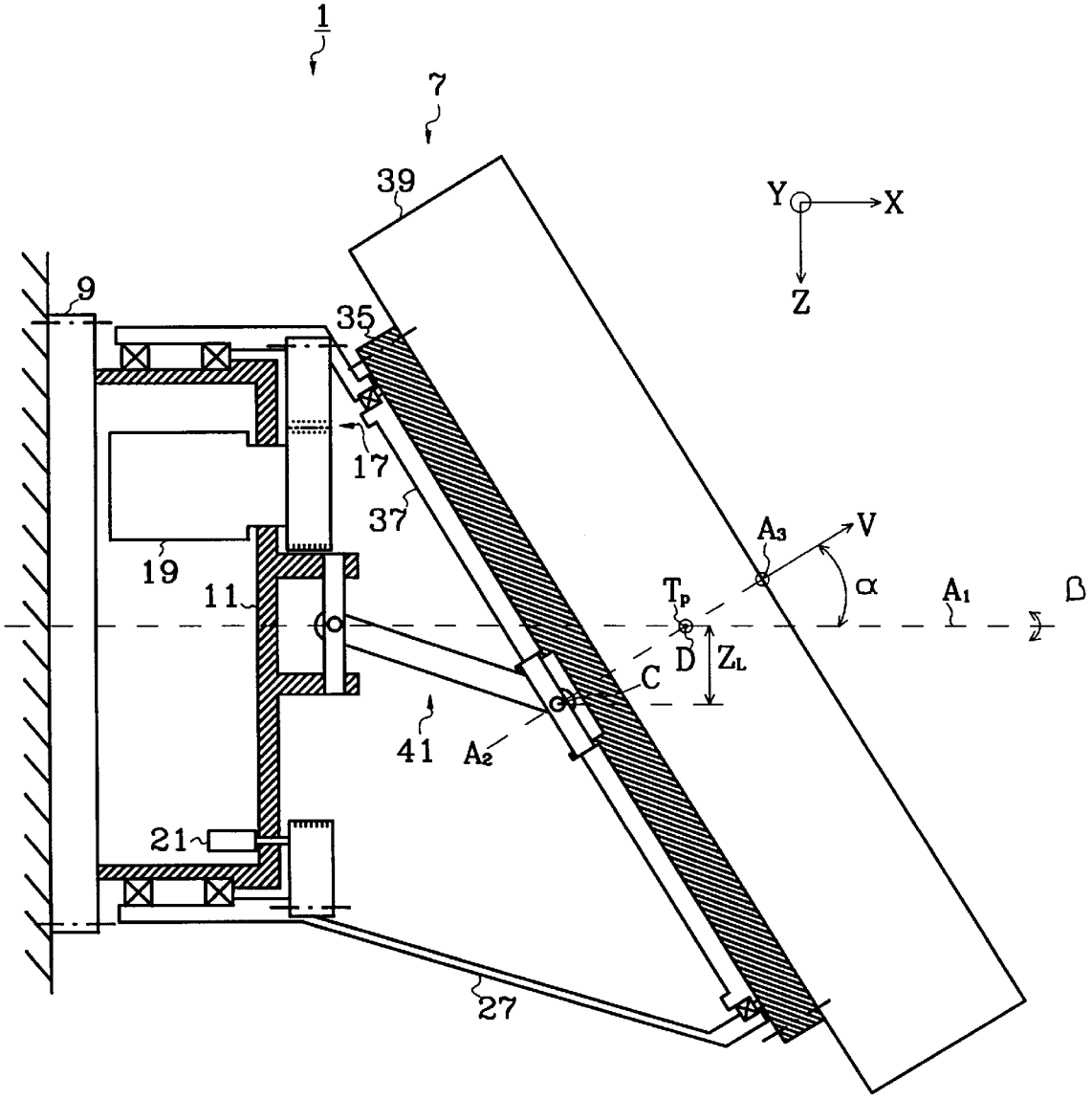
FIG. 3 shows a schematic side view of the antenna device when a movable part of the antenna device has rotated 180° according to the invention.

FIG. 3 shows a side view of the antenna device 1 when the tube 27 has turned 180° around the axis of rotation $A_1$ of the tube in relation to the example according to FIG. 1, whereby the angle of rotation β is equal to 180°.

The centre of gravity $T_p$ of the antenna part coincides, as described above, with the axis of rotation $A_1$ of the tube and the central axis $A_2$ of the outer bearing device. The axis D through the centre of gravity $T_p$ and the axis $A_3$ in the coordinate system of the antenna part is parallel with the X-Y plane in the fixed coordinate system of the antenna device.

In an alternative case to the above embodiments, the motor 19 can be placed outside the inner casing device 11, whereby the gear drive 17*a*, attached to the motor 19, cooperates with the gear ring 17*b* which is arranged with its inside towards the first end of the outside of the tube. The feedback device 21 is placed outside the tube 27 in this case, and the feedback device 21 has, for example, contact with the gear ring 17*b*, as described above.

In yet another case according to the invention, the outside of the tube 27 can be arranged on the inner casing device 11, whereby the inside of the inner bearing devices 13 is arranged on the outside of the tube, and the inner casing device 11 is arranged with its inside on the inner bearing devices 13.

In a similar way, the outside of the tube 27 can be arranged on the outer casing arrangement 37, whereby the outer bearing device 33 is arranged with its inside towards the tube 27, and the inside of the outer casing device 11 is arranged on the outer bearing arrangement 33.

I claim:

1. A device for angular adjustment of a direction-indicating object in an arbitrary direction the device comprising:

a fixed part;

a movable part which is rotatably arranged in relation to the fixed part around a first axis of rotation, the movable part comprises a tube, wherein a first end of the tube is arranged on the fixed part and a second end of the tube comprises an outer edge which is bevelled at a predetermined fixed angle;

a direction-indicating part which is rotatably arranged in relation to the bevelled outer edge of the tube around a central axis, which runs parallel with a normal to the outer edge of the tube, wherein the direction-indicating part includes the direction-indicating object;

a torsionally rigid coupling is coupled between the fixed part and the direction-indicating part, wherein the direction-indicating part, by means of the torsionally rigid coupling and the outer edge of the tube, performs a nutation movement when the movable part rotates around the first axis of rotation.

2. The device according to claim 1, wherein the first end of the tube is rotatably arranged in relation to the fixed part through at least one inner bearing, and that the direction-indicating part is rotatably arranged on the outer edge of the tube by means of at least one outer bearing.

3. The device according to claim 2, wherein one end of the torsionally rigid coupling is arranged on the fixed part on the first axis of rotation, and the other end of the torsionally rigid coupling is arranged on the direction-indicating part of the central axis.

4. The device according to claim 3, wherein a first point of the direction-indicating part coincides with the first axis of rotation of the tube and the central axis, wherein one end of the torsionally rigid coupling is attached to the fixed part of the first axis of rotation, and the other end of the torsionally rigid coupling comprises a second cardan joint, comprising a second crosslink, wherein the second crosslink runs through the first point of the direction-indicating part, the second crosslink is arranged perpendicular to a second link, and the second link is arranged on the direction-indicating part and is perpendicular to the central axis.

5. The device according claim 3, wherein one end of the torsionally rigid coupling comprises a first cardan joint, comprising a first crosslink, wherein the first crosslink intersects the first axis of rotation and is perpendicularly arranged to a first link, wherein the first link is arranged on the fixed part and is perpendicular to the first axis of rotation, and wherein a second end of the torsionally rigid coupling comprises a second cardan joint comprising a second crosslink, wherein the second crosslink intersects the central axis and is arranged perpendicular to a second link, and wherein the second link is arranged on the direction-indicating part and is perpendicular to the central axis.

6. The device according to claim 5, wherein the second crosslink runs through the center of rotation of the at least one outer bearing.

7. The device according to claim 1, wherein at least one motor via a transmission coupling, rotates the tube to an intended angle of rotation.

8. The device according to claim 7, wherein the transmission coupling is a gear coupling, and wherein the gear coupling comprises a gear drive and a gear ring which cooperate with each other, the gear drive is attached to the motor and the gear ring is attached to the first end of the tube.

9. The device according to claim 8, wherein a feedback device is in contact with the gear ring, and wherein feedback device reads the angle of rotation of the tube.

10. The device according to claim 8, wherein a feedback device is in contact with the inside of the tube, wherein the feedback device reads the angle of rotation of the tube.

11. The device according to claim 1, wherein the center of gravity of the direction-indicating part coincides with the first axis of rotation of the tube and the central axis.

12. The device according to claim 11, wherein a signal direction of the direction-indicating object can be complemented with an electronic angular adjustment, wherein the electronic angular adjustment displaces the signal direction an intended turning angle in relation to the selectable direction of the direction-indicating object.

13. A device for angular adjustment of an antenna, the device comprising:

a fixed portion;

a rotatable tube attached to the fixed portion, wherein the rotatable tube rotates around a first axis of rotation; and an antenna attached to the rotatable tube, wherein the antenna performs a nutation movement around a center of gravity of the antenna as a function of the rotation of the rotational tube, and wherein the antenna remains stationary with respect to the first axis of rotation during the nutation movement.

14. The device of claim 13, further comprising:

bearings which contact an inner portion of the rotatable tube.

15. The device of claim 13, further comprising:

a motor; and a gear drive attached to the motor, wherein the gear drive engages an internal gear ring on an inner portion of the rotatable tube such that the motor causes the rotatable tube to rotate around the first axis.

16. The device of claim 13, further comprising:

a feedback device which contacts an internal gear ring on an inner portion of the rotatable tube, wherein the feedback device determines an angle of rotation of the rotatable tube around the first axis.

17. The device of claim 13, wherein an outer edge of the rotatable tube is beveled to a fixed angle such that the beveled outer edge of the rotatable rotor is parallel to a central axis of the rotation of the rotatable rotor.

18. The device of claim 13, further comprising:

a coupling connected between the fixed potion and the antenna to prevent rotational movement of the antenna in relation to the fixed portion.

19. A device for angular adjustment of a direction-indicating object in an arbitrary direction the device comprising:

a fixed part;

a movable part which is rotatably arranged in relation to the fixed part around a first axis of rotation, the movable part comprises a tube, wherein a first end of the tube is arranged on the fixed part and a second end of the tube comprises an outer edge which is bevelled at a predetermined fixed angle;

a direction-indicating part which is rotatably arranged in relation to the bevelled outer edge of the tube around a central axis, which runs parallel with a normal to the outer edge of the tube, wherein the direction-indicating part includes the direction-indicating object;

a torsionally rigid coupling is coupled between the fixed part and the direction-indicating part, wherein the direction-indicating part, by means of the torsionally rigid coupling and the outer edge of the tube, performs a nutation movement when the movable part rotates around the first axis of rotation, wherein the center of gravity of the direction-indicating part coincides with the first axis of rotation of the tube and the central axis.

* * * * *